United States Patent [19]

Nakajima et al.

[11] 4,047,510

[45] Sept. 13, 1977

[54] EXHAUST GAS RECIRCULATION SYSTEM WITH CONTROL APPARATUS FOR EXHAUST GAS FLOW CONTROL VALVE

[75] Inventors: Yasuo Nakajima, Yokosuka; Yoshimasa Hayashi, Yokohama; Yasuo Takagi, Yokohama; Kunihiko Sugihara, Yokohama; Syunichi Aoyama, Yokohama, all of Japan

[73] Assignee: Nissan Motor Company, Limited, Japan

[21] Appl. No.: 588,239

[22] Filed: June 19, 1975

[30] Foreign Application Priority Data

June 27, 1974 Japan ..... 49-73704

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,739,797 | 6/1973 | Caldwell | 123/119 A |
| 3,774,583 | 11/1973 | King | 123/119 A |
| 3,796,049 | 3/1974 | Hayashi | 123/119 A |
| 3,814,070 | 6/1974 | Wertheimer | 123/119 A |
| 3,818,880 | 6/1974 | Dawson et al. | 123/119 A |
| 3,877,452 | 4/1975 | Nohira | 123/119 A |
| 3,896,777 | 7/1975 | Masaki et al. | 123/119 A |
| 3,915,136 | 10/1975 | Caldwell | 123/119 A |
| 3,924,589 | 12/1975 | Nohira | 123/119 A |
| 3,926,161 | 12/1975 | Wertheimer | 123/119 A |

*Primary Examiner*—Carroll B. Dority, Jr.
*Assistant Examiner*—David D. Reynolds
*Attorney, Agent, or Firm*—Robert E. Burns; Emmanuel J. Lobato; Bruce L. Adams

[57] ABSTRACT

An exhaust gas recirculation system for an internal combustion engine comprises an exhaust gas flow control valve; a vacuum actuator for operation of the flow control valve; and a control apparatus which provides an output vacuum to be applied to the vacuum actuator which is an amplification of the venturi vacuum.

3 Claims, 2 Drawing Figures

EXHAUST GAS RECIRCULATION SYSTEM WITH CONTROL APPARATUS FOR EXHAUST GAS FLOW CONTROL VALVE

BACKGROUND OF THE INVENTION

The present invention relates to an exhaust gas recirculation system in an internal combustion engine, and more particularly to a control apparatus for an exhaust gas flow control valve of exhaust gas recirculation system.

Heretofore, there have been many proposals to introduce, throughout all operating conditions of an internal combustion engine, a substantially inert gas such as exhaust gas into the intake system; i.e. into the intake manifold or into the induction passage at a location downstream of the air filter; with the intention of reducing the concentration of nitrogen oxides ($No_x$) in the engine exhaust gases by suppressing their formation. It is required that a suitable amount of exhaust gas be introduced into the intake system of the engine to attain satisfactory results. A reduction in engine performance results if the ratio of the flow rate of recirculated exhausted gas to that of intake air exceeds a certain optimum value, and failure to suppress the formation of nitrogen oxides results if the ratio is much smaller than the certain optimum value. If intake manifold vacuum is employed to actuate a valve for controlling the flow of exhaust gas into the intake system of the engine, as is common in the prior art, it is hardly possible to maintain the flow rate ratio of recirculated exhaust gas to intake air at an optimum value mostly due to the fact that the vacuum in the intake manifold does not vary in proportion to the intake air flow rate throughout operation of the engine.

It has been confirmed that the vacuum in the venturi of a carburetor varies in relation to the velocity of air flowing through the venturi throughout operation of the engine, and therefore in relation to the flow rate of intake air being introduced into the engine. Thus, if the vacuum in the venturi is employed as a variable in controlling the amount of exhaust gas introduced into the intake system, the flow rate of exhaust gas can be metered to an optimum ratio to that of intake air throughout all modes of operation of the engine. However, the vacuum in the venturi is not strong enough for adequate control of a vacuum actuated valve to meter the flow rate of recirculated exhaust gas.

Conventionally, an exhaust gas recirculation system has a control apparatus providing a vacuum output which is an amplification of a vacuum in the venturi of a carburetor to a valve actuator of an exhaust gas flow control valve thereby to open an exhaust recirculation conduit responsive to changes in the venturi vacuum. When, in the conventional exhaust gas recirculation system, the intake manifold vacuum increases with the venturi vacuum remains unchanged, the flow rate ratio of recirculated exhaust gas to intake air increases above an optimum valve because flow rate of the exhaust gas through the recirculation conduit increases as the intake manifold increases even if the opening degree by the flow control valve is constant. Thus with the conventional exhaust gas recirculation system it is difficult to keep the flow rate of exhaust gas to an optimum ratio to that of intake air throughout all modes of operation of the engine. It is desirable that the opening degree of the flow control valve be decreased as the intake manifold vacuum increases or be increased as the intake manifold vacuum decreases so as to keep the flow rate ratio of recirculated exhaust gas to the venturi vacuum at an optimum value.

SUMMARY OF THE INVENTION

It is accordingly an object of the present invention to provide an exhaust gas recirculation system having a control apparatus which has a vacuum output which is an amplification of a vacuum in the venturi of a carburetor (the venturi vacuum) but modified by variation of a vacuum in the intake manifold vacuum (the intake manifold vacuum).

BRIEF DESCRIPTION OF THE DRAWINGS

The present invention will become clear as this description progresses with reference to the accompanying drawings, in which.

DESCRIPTION OF THE PREFERRED EMBODIMENTS

Figure 1:
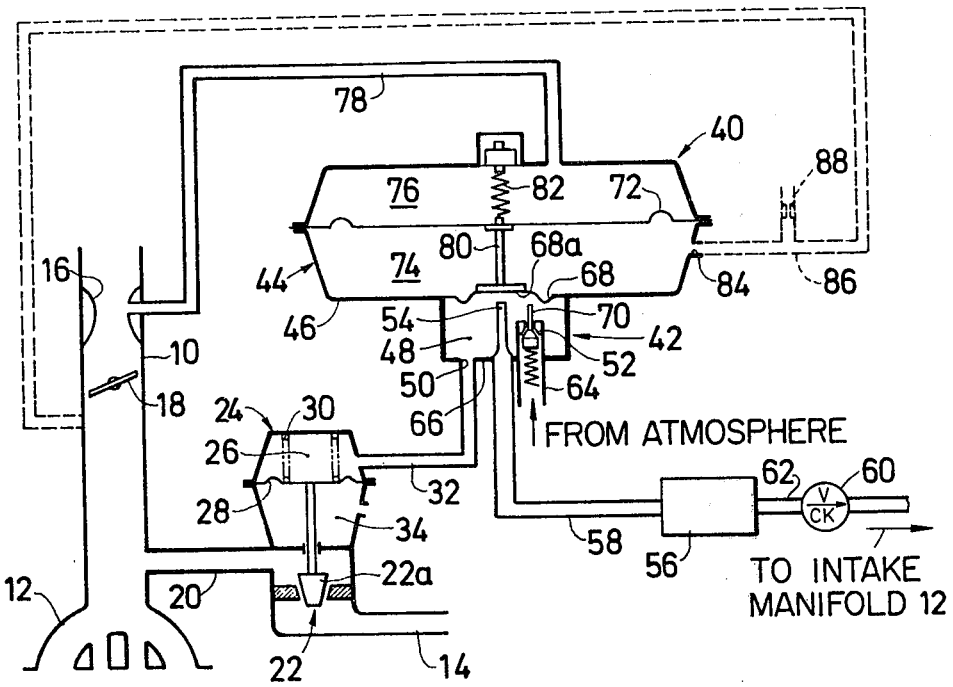
FIG. 1 shows an exhaust gas recirculation system in accordance with the present invention.

Referring to FIG. 1 of the drawings, an exhaust gas recirculation system is shown as incorporated into an internal combustion engine which may be of any conventional design, being provided with a usual carburetor 10, an intake manifold 12, and exhaust pipe 14 leading from an exhaust manifold (not shown). The carburetor 10 is provided with a venturi section 16 and a throttle flap 18.

The exhaust gas recirculation system includes an exhaust gas recirculation conduit 20 connecting the exhaust pipe 14 with the intake manifold 12 to recirculate a portion of the engine exhaust gas to the intake manifold 12. An exhaust gas flow control valve 22 is mounted in the recirculation conduit 20. The exhaust gas flow control valve 22 normally closes the recirculation conduit 20. The valve 22 is urged toward its open position by a valve actuator 24. The valve actuator 24 includes a vacuum chamber 26 and a flexible diaphragm 28 operatively connected to a valve member **22*a* to urge the valve member 22*a* against a compression spring 30 toward its opening position so as to open the recirculation conduit 20 responsive to a vacuum in the vacuum chamber 26. The vacuum chamber 26 above the diaphragm 28 is connected by a vacuum conduit 32 to a control apparatus generally designated as 40, whereas a chamber 34 beneath the diaphragm 28** is open to the atmosphere as shown.

The degree of vacuum present in the vacuum chamber 26 is controlled by the control apparatus 40 comprised of a vacuum regulator 42 and a vacuum motor 44 for actuating the regulator 42. The vacuum regulator 42 and the vacuum motor 44 are ombined in a unitary structure.

The control apparatus 40 includes a housing 46 having a vacuum regulating chamber 48. The vacuum regulating chamber 48 has an inlet port 50 connected to the vacuum chamber 26 through a vacuum conduit 32 for actuation of the diaphragm 28 by vacuum produced in the vacuum regulating chamber 48. The regulating chamber has an air bleed port 52 and an outlet port 54 connected to a vacuum reservoir or source 56 by a vacuum pipe 58, the vacuum reservoir 56 being connected to the engine intake manifold 12 through a check valve 60 and a vacuum pipe 62.

The outlet port 54 is defined in the end portion of the vacuum pipe 58 projecting inwardly of the vacuum regulating chamber 48, and the air bleed port 52 is defined in a boss 64 projecting inwardly of the vacuum regulating chamber 48. The vacuum regulating chamber 48 is defined, on the side opposite wall 66, by a flexible diaphragm means 68. The flexible diaphragm means 68 has a valve portion 68*a* engageable with the outlet port 54 and is movable in increases and decreases of pressure in the vacuum regulating chamber 48 to bring the portion 68*a* into and out of closing engagement with the outlet port 54. The boss 64 has an air bleeder valve 70 normally closing the air bleed port 52 under the influence of a spring but is opened by the diaphragm 68 upon further flexing downwardly of the diaphragm 68 due to increase of vacuum in the vacuum regulating chamber 48.

The diaphragm 68 is actuated by the vacuum motor 44 comprising a flexible diaphragm 72. The diaphragm 72 cooperates with the diaphragm 68 to form a biasing chamber 74 and its upper side is exposed to a venturi vacuum chamber 76 communicating with the venturi section 16 of the carburetor 10 by a vacuum conduit 78. A rod 80 mechanically interconnects the two diaphragms 68 and 72.

When the valve portion 68*a* is raised by the diaphragm 68 to the illustrated position in which the air bleed port 52 is closed and the outlet port 54 is opened, the vacuum conduit 58 effects communication of the vacuum regulating chamber 48 with the vacuum reservoir 56. When the valve portion 68*a*is lowered by the diaphragm 68, the outlet port 54 is closed, and further lowering of the diaphragm 68 opens the air bleed port 52. The reduction of the vacuum by this action tends to cause the diaphragm 68 to be moved upwardly, thereby sequentially closing the air bleed port 52 and then opening the outlet port 54, thereby connecting the vacuum regulating chamber 48 with the vacuum reservoir 56. An equilibrium is established whereby a vacuum of a predetermined value is produced in the vacuum regulating chamber 48 according to an upward force applied to the diaphragm 68.

To provide a vacuum output in the vacuum regulating chamber 48 which is an amplification of the venturi vacuum in the venturi vacuum chamber 76 and acting on the upper side of the diaphragm 72, an effective area of the diaphragm 72 is formed to be considerably larger than that of the diaphragm 68 and a tension spring 82 mechanically biases the diaphragm 72 upwardly.

The biasing chamber 74 has a vent port 84 opening to the atmosphere. Preferably the biasing chamber 74 is connected with the intake manifold 12 by means of a vacuum conduit shown in imaginary or broke lines and designated as 86. The vacuum conduit 86 has an air bleeder orifice 88 having a restriction chosen such that a vacuum present in the biasing chamber 74 is a reduction of a vacuum in the intake manifold 12 and is considerably lower than a vacuum in the venturi vacuum chamber 76. It will be understood that an upward force applied to the diaphragm 68 by the diaphragm 72 due to the venturi vacuum and by the spring 82 is reduced as the intake manifold vacuum increases, thereby causing a corresponding reduction of vacuum in the vacuum regulating chamber 48. Thus it will now be appreciated that if the intake manifold vacuum increases with the venturi vacuum remained constant, the valve member 22*a* of the flow control valve 22 is caused to decrease the opening degree of the recirculation conduit 20.

In the control apparatus 40 illustrated in FIG. 1, the air bleeder valve 70 includes a valve member integral with a stem which is spaced from the diaphragm 68.

Figure 2:
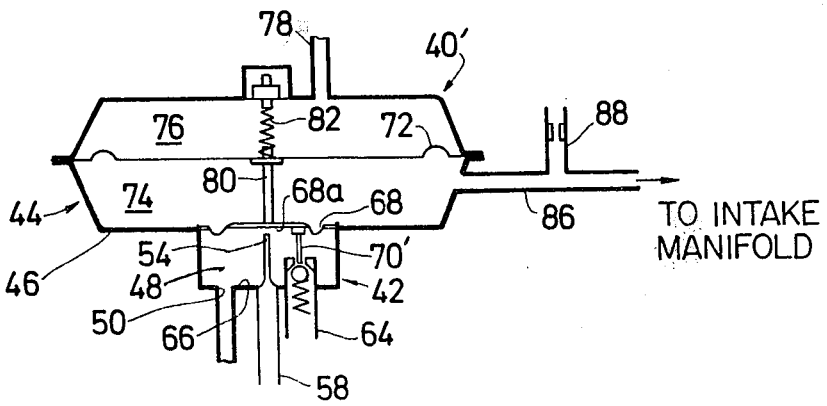
FIG. 2 shows a modification of a vacuum regulator used in FIG. 1.

FIG. 2 shows a similar control apparatus 40' to the control apparatus 40 shown in FIG. 1 and the same numerals to those used in FIG. 1 are used in FIG. 2 to designate like parts. Only difference resides in an air bleeder valve 70'. The air bleeder valve 70'includes a ball valve member normally closed by a spring and a separate stem secured to a valve portion 68*a*.

It will now be understood that the output vacuum in the vacuum regulating chamber 48 is an amplification of the venturi vacuum as far as the biasing chamber 74 is opened to the atmosphere or the reduced manifold vacuum induced in the biasing chamber 74 is substantially at constant level, but the output vacuum decreases as the reduced intake manifold increases or it increases as the reduced manifold vacuum decreases even if the venturi vacuum is at a constant level.

What is claimed is:

1. An exhaust gas recirculation system for use on an internal combustion engine having an intake system and an exhaust system comprising:

a recirculation conduit to recirculate a portion of exhaust gas from the exhaust system of an internal combustion engine to an intake system having a carburetor and an intake manifold;

an exhaust gas flow control valve normally closing said recirculation conduit;

a valve actuator including a vacuum chamber and a diaphragm operatively connected to said exhaust gas flow control valve to urge said exhaust gas flow control valve toward its open position so as to open said recirculation conduit responsive to a vacuum in the vacuum chamber of said valve actuator; and a control apparatus comprising:

a housing having a vacuum regulating chamber, said vacuum regulating chamber having an inlet port connected to the vacuum chamber of said valve actuator, an air bleed port and an outlet port connected in operation to a vacuum source;

a first flexible diaphragm means defining a wall of said vacuum regulating chamber;

a second flexible diaphragm means cooperating with said first flexible diaphragm means for defining said housing and between said first and second diaphragm means a biasing chamber, said second flexible diaphragm means forming on the opposite side of a side exposed to said biasing chamber and in said housing a venturi vacuum chamber communicating with the venturi of the carburetor;

means mechanically interconnecting said first and second flexible diaphragm means;

said first diaphragm means having a valve portion engageable with said outlet port, said first diaphragm means being movable in increase and decrease of pressure in said vacuum regulating chamber to bring said valve portion into out of closing engagement with said outlet port;

said second diaphragm means having an effective area larger than that of said first diaphragm means;

an air bleeder valve means for opening said air bleed port in response to further flexing of said first diaphragm means due to increase of vacuum in said vacuum regulating chamber after closing of said outlet port;

a vacuum conduit having an air bleeder orifice, said vacuum conduit connecting said biasing chamber with the intake manifold, and said air bleeder orifice having a restriction chosen such that a vacuum in said biasing chamber is a reduction of a vacuum in the intake manifold and is lower than a vacuum in said venturi vacuum chamber.

2. An exhaust gas recirculation system as claimed in claim 1, in which said air bleeder valve means comprises a tapered conical valve element.

3. An exhaust gas recirculation system as claimed in claim 1, in which said air bleeder valve means comprises a ball valve element.

* * * * *